US006394287B2

(12) United States Patent
Cabrera

(10) Patent No.: US 6,394,287 B2
(45) Date of Patent: May 28, 2002

(54) GOLF CLUB CLEANING RACK

(76) Inventor: Luis H. Cabrera, 278 4th St., Broadway, VA (US) 22815

( * ) Notice: Subject to any disclaimer, the term of this patent is extended or adjusted under 35 U.S.C. 154(b) by 0 days.

(21) Appl. No.: 09/842,066

(22) Filed: Apr. 26, 2001

Related U.S. Application Data

(63) Continuation-in-part of application No. 09/593,388, filed on Jun. 14, 2000, now Pat. No. 6,299,000.

(51) Int. Cl.[7] ..... A47F 5/00

(52) U.S. Cl. ..... 211/70.2; 211/104; 211/89.01; 211/118

(58) Field of Search ..... 211/70.2, 87.01, 211/104, 89.01, 68, 65, 66, 70.6, 118

(56) References Cited

U.S. PATENT DOCUMENTS

| | | | | |
|---|---|---|---|---|
| 1,678,353 A | | 7/1928 | Reach | |
| 1,719,360 A | | 7/1929 | Deike | |
| 1,835,632 A | | 12/1931 | Buhrke | |
| 2,621,799 A | | 12/1952 | Wilson | |
| 2,737,990 A | | 3/1956 | De Marco | |
| 3,748,676 A | | 7/1973 | Warren et al. | |
| 4,387,873 A | * | 6/1983 | Pavlo et al. | |
| 4,821,358 A | | 4/1989 | Wyckoff et al. | |
| 4,899,894 A | | 2/1990 | Crump | |
| D308,766 S | | 6/1990 | Van Rensburg | |
| 4,951,339 A | | 8/1990 | Braun | |
| 4,965,906 A | | 10/1990 | Mauro | |
| 4,986,427 A | * | 1/1991 | Law et al. | 211/64 |
| 5,121,833 A | * | 6/1992 | Lindsay et al. | |
| 5,141,113 A | * | 8/1992 | Elliott | 211/118 X |
| 5,155,883 A | | 10/1992 | Legault | |
| 5,209,539 A | | 5/1993 | Atalay | |
| 5,213,364 A | | 5/1993 | Theckston | |
| 5,259,497 A | * | 11/1993 | Brothers et al. | |
| 5,295,587 A | * | 3/1994 | Downes et al. | 211/118 X |
| D350,630 S | | 9/1994 | Smith | |
| 5,383,555 A | | 1/1995 | Weinmeier | |
| D364,912 S | | 12/1995 | Sowers | |
| D367,908 S | | 3/1996 | Byers | |
| 5,560,066 A | | 10/1996 | McDivitt | |
| D384,503 S | | 10/1997 | Kyrwood | |
| 5,687,979 A | | 11/1997 | Plevka | |
| 5,738,229 A | | 4/1998 | Fairweather | |
| 5,829,604 A | | 11/1998 | Brophy | |
| 5,915,432 A | | 6/1999 | Trummer | |
| 5,940,918 A | | 8/1999 | Binette | |
| 5,957,308 A | * | 9/1999 | Zievenberg | 211/118 X |
| 5,964,346 A | | 10/1999 | O'Connor | |
| 6,032,999 A | | 3/2000 | York et al. | |
| 6,299,000 B1 | * | 10/2001 | Cabrera | 211/70.2 |

FOREIGN PATENT DOCUMENTS

| | | |
|---|---|---|
| CA | 2110481 | 8/1997 |
| EP | 0 488 970 A1 | 6/1992 |
| FR | 2 701 657 | 8/1994 |

* cited by examiner

*Primary Examiner*—Robert W. Gibson, Jr.
(74) *Attorney, Agent, or Firm*—Richard C. Litman

(57) ABSTRACT

A multiple golf club cleaning aid rack for cleaning clubs, which is a vertically arrayed, rectangular fabric sheet reinforced with a plurality of horizontal metal strips in pockets and supporting a double row of clamps for holding golf clubs vertically. The rack is suspended from clamps for cleaning by a power wash in car wash establishment. Suspending apertures are formed through the top of the rack for suspending it on a wall for use elsewhere, such as at home.

14 Claims, 3 Drawing Sheets

GOLF CLUB CLEANING RACK

This application is a continuation-in-part of application Ser. No. 09/593,388, filed Jun. 14, 2000 now U.S. Pat. No. 6,299,000.

BACKGROUND OF THE INVENTION

1. Field of the Invention

The present invention relates generally to cleaning devices. More specifically, the invention is a golf club set cleaning rack made of water repellant fabric, for hanging up with carpet holders in a car wash establishment.

2. Description of the Related Art

The related art of interest describes various golf ball or club head cleaning devices, but none discloses the cleaning rack for a car wash establishment. There is a need for an efficient and quick washing apparatus utilizing the power washing available in a car wash establishment, but also useful elsewhere, e.g., at home. The relevant art will be discussed in the order of perceived relevance to the present invention.

U.S. Pat. No. 1,719,360 issued on Jul. 2, 1929, to Ulric C. Deike describes a golf club rack comprising a transversely L-shaped notched support bar wherein each notch has a locking member pivoting on a pivot pin. Another horizontal bar positioned below has spaced notches to align the handles. The rack is distinguishable for requiring permanent installation by fasteners to a wall and the lack of a connecting portion between the two support bars.

U.S. Pat. No. 1,678,353 issued on Jul. 24, 1928, to William F. Reach describes a holder rack for storing and displaying a set of golf clubs vertically. The rectangular rack includes three grooved horizontal crossbars and two rotatable holding crossbars. The rack is distinguishable for its different structure for holding the clubs vertically.

U.S. Pat. No. 4,899,894 issued on Feb. 13, 1990, to Gregory A. Crump describes a magnetic golf club holding apparatus for holding golf clubs in an address position. Magnetic bars are horizontally arranged on a vertical slat wall in a third embodiment. The slat wall apparatus is distinguishable for its required magnetic golf club holders.

U.S. Pat. No. 5,209,539 issued on May 11, 1993, to Michael Atalay describes a portable golf club carrier and support device capable of being stored in a golf bag comprising a pair of downwardly extending, planar leg supports pivotally engaged on top and ending in triangular feet. Eight clips on each side support golf clubs horizontally. A cylindrical housing for golf balls are positioned proximate the feet. The device is distinguishable for requiring a bipod structure.

U.S. Pat. No. 1,835,632 issued on Dec. 8, 1931, to Alfred E. Buhrke describes a golf club clamping device comprising two rectangular sheet metal parts (each with semicircular openings padded with rubber sponge), a hinge at one end, and a closure at the opposite end. A pair of these clamps can be used to hold a set of clubs together. The clamping devices are distinguishable for requiring unconnected clamps to hold a set of golf clubs.

U.S. Pat. No. 5,383,555 issued on Jan. 24, 1995, to Robert J. Weinmeier describes a golf club securer and organizer device for insertion in a golf club bag comprising a stiff peripheral frame molded in a ring having a series of increasing height and mounting a resilient clamp. The ring is clamped to the bag by a rod and clamp system. The device is distinguishable for its structure for fitting inside a golf club bag.

U.S. Pat. No. 5,738,229 issued on Apr. 14, 1998, to Brian D. Fairweather describes a golf club display rack comprising two horizontal semicircular rack portions having J-shaped slots and decreasing diameters (from top to bottom) and two lower and smaller diameter semicircular bases fastened to a wall in FIGS. 1–3. The rack is distinguishable for its dissimilar structure.

U.S. Des. Pat. No. 384,503 issued on Oct. 7, 1997, to Geoff Kyrwood describes an ornamental golf club holder for positioning on top of a golf club bag comprising a horizontal rack with upwardly facing parallel bookend-type separators on three legs which attach to the golf bag with the center leg being hinged. The holder device is distinguishable for its unique bookend structure.

U.S. Des. Pat. No. 364,912 issued on Dec. 5, 1995, to G. Wayne Sowers describes an ornamental golf club holder as best understood comprising a flexible piece having a hooked portion having an arcuate opening in front and overlying a horizontal plate on a base portion. The device is distinguishable as being an individual golf club holder.

U.S. Pat. No. 5,964,346 issued on Oct. 12, 1999, to James C. O'Connor describes an add-on golf club organizer inserted on the top outside edge of a golf bag comprising a flexible strip having clamps to grip the bag and slots with cantilever fingers to prevent the extra golf clubs from slipping out. The device is distinguishable for its limitation to a golf bag.

European Patent Application No. 0 488 970 A1 published on Jun. 3, 1992, for Vincenzo Sciola describes a wall shower apparatus comprising a rectangular body case having bristles, sponge or horsehair in front, said case incorporating a tank of soapy water and a finger pump. The apparatus has four guide rods for attaching to a shower wall. The apparatus is distinguishable for its limitation to an integrated wall shower cleaner.

Canadian Patent Application No. 2,110,481 published on Aug. 12, 1997, for Fang-Li Wu describes a golf club and ball rack for posting vertically in the ground temporarily comprising a vertical rod having a bent section for holding a four-ball carrier, a locating disk for holding club shafts, a support base with cups for holding the golf club handles, a round below the support base, a ground spike, a binding band to hold the clubs, and a carrying strap. The rack is distinguishable for its grouping of the clubs in a circle around the vertical rod.

U.S. Des. Pat. No. 367,908 issued on Mar. 12, 1996, to David D. Byers describes an ornamental ball caddy for ball washing comprising three ball containers joined with a snap clip hanger. It is unclear how the balls are held by the holder. The ball caddy is not relevant to the present invention involving only golf clubs.

U.S. Pat. No. 4,965,906 issued on Oct. 30, 1990, to Edward Mauro describes a combination golf ball and club head cleaning device mountable on a post or a golf cart. A housing has two compartments for separately and manually cleaning golf balls and club heads. Each compartment contains brushes and aqueous cleaning solutions. The device is distinguishable for cleaning only single club heads.

U.S. Pat. No. 5,560,066 issued on Oct. 1, 1996, to Mark W. McDivitt describes a portable golf club head cleaning device having a rotatable brush and recirculating pump powered by a power supply. The device is distinguishable for its required motorized brush cleaning of golf club heads.

U.S. Des. Pat. No. 308,766 issued on Jun. 26, 1990, to Johannes C. J. Van Rensburg describes an ornamental golf club cleaner comprising a series of aligned bristles inside and outside an open casing operated to move by a battery in an angled handle. The casing has a full removable cover. The device is distinguishable for its hand operated mechanism.

U.S. Pat. No. 4,951,339 issued on Aug. 28, 1990, to Stephen C. Braun describes a motor powered cleaning machine for golf clubs comprising an L-shaped housing on a base. The club head is inserted into a tray containing a cleaning solution and a round brush. The machine is distinguishable for its motorized structure.

U.S. Pat. No. 5,915,432 issued on Jun. 29, 1999, to Marcus A. Trummer describes a golf club cleaner device for deep cleaning club heads after each stroke of play comprising a handheld, water resistant, rechargeable, battery operated module having multiple horizontal and vertical bristle brushes. The device is distinguishable for its brush and handheld structure.

U.S. Des. Pat. No. 350,630 issued on Sep. 13, 1994, o Eric L. Smith describes an ornamental golf ball cleaner comprising a replica of a golf ball on a circular stand having a hinge for the hemispheres and a hinge for a small door in the upper hemisphere. The device is distinguishable for its unique singular golf ball structure.

French Patent Application No. 2 701 657 published on Aug. 26, 1994, for Maurice Le Floch describes an apparatus for cleaning golf club heads comprising a housing on legs including a longitudinal top opening for insertion of the golf club head between two counter-rotating brushes driven by a motor and a tray for collection of the debris. The apparatus is distinguishable for its motorized brush cleaning structure.

U.S. Pat. No. 2,737,990 issued on Mar. 13, 1956, to Joseph J. De Marco describes a golf club mounted and golf ball carrier having an aluminum tubing frame and a bottom spike for driving into the ground for play and carrying the clubs and balls by the fabric sleeved top cross arm. The clubs are mounted horizontally in pairs by spring clamps on the side arms. The device is distinguishable for its spiked frame structure.

U.S. Pat. No. 5,213,364 issued on May 25, 1993, to Dana L. Theckston describes a golf club holder and dispenser device mounted on the rear of a golf cart. A housing contains a rotating motorized frame with notches to hold the clubs accessible by a transparent cover on top. Some clubs are held by brackets on the rear of the housing. Two drawers are added below the housing. The housing device is distinguishable for its motorized club holding frame.

U.S. Pat. No. 6,032,999 issued on Mar. 7, 2000, to Michael T. York et al. describes a golf club and accessory carrier having a top handle connecting two Christmas tree shaped ends having clips for holding clubs on its sides. A lower frame holds golf balls. The thin portion of the sides above the feet has clips for tees. The carrier is distinguishable for having a Christmas tree configuration for holding golf clubs horizontally.

U.S. Pat. No. 4,821,358 issued on Apr. 18, 1989, to Charles W. Wychoff et al. describes a golf club head cleaner device for mounting on posts or to a golf cart comprising an upright cylindrical housing with a removable top cover having an elongated slot for insertion of an iron club head. Two opposing brush blocks are held inside with cleaning fluid, and the club head is moved vertically for cleaning. The device is distinguishable for its limitation to cleaning only one club head at a time.

U.S. Pat. No. 5,155,883 issued on Oct. 20, 1993, to Raymond L. Legault describes a combination golf club head and ball washer device comprising a box with an external crank handle rotating two brushes by gearing in counter rotation. The box contains an aqueous detergent solution. The lid has a tubular member for inserting golf balls. The lid can be tilted up for insertion of a club head for cleaning. The device can be attached to a vertical wall. The device is distinguishable for its individual washing of club heads and golf balls in a box with a crank driving two brushes and containing a cleaning solution.

U.S. Pat. No. 5,940,918 issued on Aug. 24, 1999, to Marc R. Binette describes an apparatus for cleaning a golf club head comprising a housing having a top with separate openings for right and left handed club heads for brushing by an external crank handle. No cleaning solution is involved. The apparatus is distinguishable for its dry brushing of a single club head.

U.S. Pat. No. 2,621,799 issued on Dec. 16, 1952, to David E. Wilson describes an U-shaped collar for golf clubs.

U.S. Pat. No. 3,748,676 issued on Jul. 31, 1973, to Allyn G. Warren et al. describes a golf club ball wash rack.

U.S. Pat. No. 5,687,979 issued on Nov. 18, 1997, to Dean A. Plevka describes storage attachments for wheelbarrows.

U.S. Pat. No. 5,829,604 issued on Nov. 3, 1998, to Henry F. Brophy describes a golf club rack apparatus.

None of the above inventions and patents, taken either singularly or in combination, is seen to describe the instant invention as claimed. Thus, a golf club cleaning rack solving the aforementioned problems is desired.

SUMMARY OF THE INVENTION

The invention is a golf club set cleaning aid for use in car wash establishments which provide hanging clamps and the pressurized washing fluids. This device has a rectangular fabric mesh having pockets located on the top edge, proximate the top edge and at the bottom edge. The pockets include planar aluminum strips for maintaining a degree of rigidity for the device. The pockets support brackets or clips at two levels, i.e., the bottom pocket and its adjacent pocket, and in-line to hold the golf clubs vertically. The top pocket and the aluminum insert can have apertures for hanging the invention.

Accordingly, it is a principal object of the invention to provide a multiple golf club cleaning rack for hanging the golf clubs vertically on a car wash or the like wall.

It is another object of the invention to provide a multiple golf club cleaning rack made essentially of a fabric mesh support.

It is a further object of the invention to provide the fabric mesh support with three horizontal pockets.

Still another object of the invention is to provide the three horizontal supports with a planar metal inserted in each pocket.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
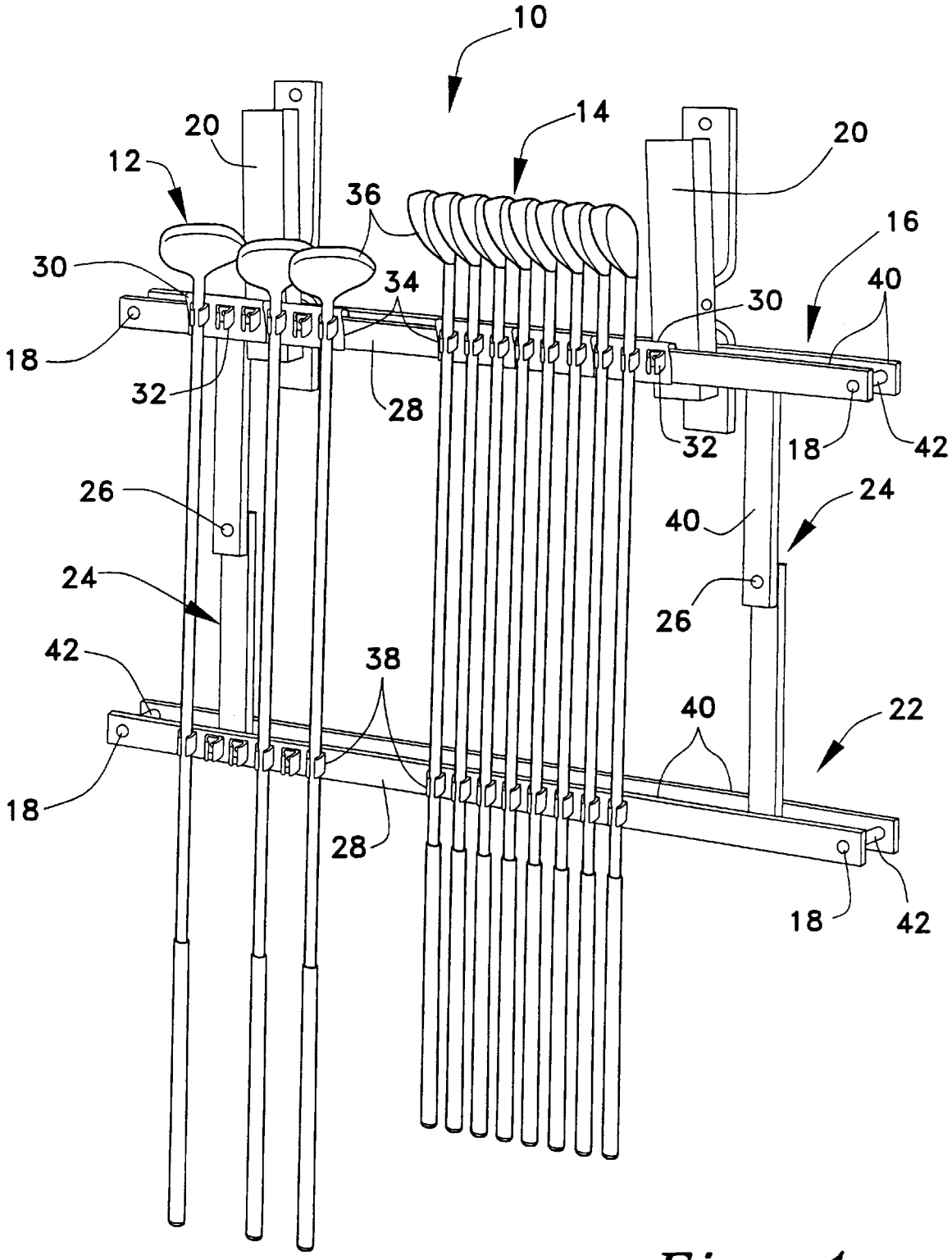
FIG. 1 is an environmental, perspective view of a prototype embodiment of a golf club cleaning rack according to the invention.

The present invention in FIG. 1 describes a multiple golf club cleaning rack 10 for mounting on a wall of a car wash establishment. The golf clubs are conveniently arranged vertically in groups such as the woods 12 and the irons 14, which differ in shaft lengths and club head sizes. The rack 10 is made up of a first horizontal set of two parallel bars 16 at a first height connected by fasteners 18 at each end to leave a space between them for clamping by the wall clamps 20, conveniently provided in some car wash establishments for cleaning car mats and rugs; cleaning is accomplished by using pressurized hot and soapy water.

A second horizontal set of two spaced parallel bars 22 connected by fasteners 18 at each end is positioned below the first set of bars 16. The parallel bars are connected proximate their ends by vertically oriented crossbars 24 which are hinged at a midpoint 26 in order to conveniently fold or collapse the rack 10 for portage or storage.

Each front bar 28 of the first and second sets of parallel bars 16, 22, respectively, has brackets for holding the golf clubs 12, 14. A pair of clamps 20 are usually positioned on a car wash wall for washing car rugs or mats by soap and a powered hot water hose. Therefore, the rack 10 can be conveniently held by the available wall clamps 20 for cleaning the arrayed clubs with a power wash. There is a distinct and unexpected advantage for holding the clubs 12, 14 in a vertical position, because one does not have to stoop to clean the sides of the club heads, which might be necessary if the clubs were placed in a horizontal attitude.

The upper golf club holding brackets 32 are mounted on a continuous plastic clamp 34 having a bulbous head to project the golf club heads 36 slightly forward. The lower brackets 38 are divided into two sets for the wood drivers 12 and for the iron clubs 14. The rack 10 is made of aluminum strips 40 except for the club holding brackets 32 and 38 which are made of flexible rubber or plastic material.

Each end of the first and second horizontal sets of bars 16 and 22 are separated by fasteners 16 which are covered with plastic tubing 42.

It should be noted that the rack 10 can be mounted on a homeowner's garage wall for cleaning the clubs with a hose and brush, for example.

Figure 2:
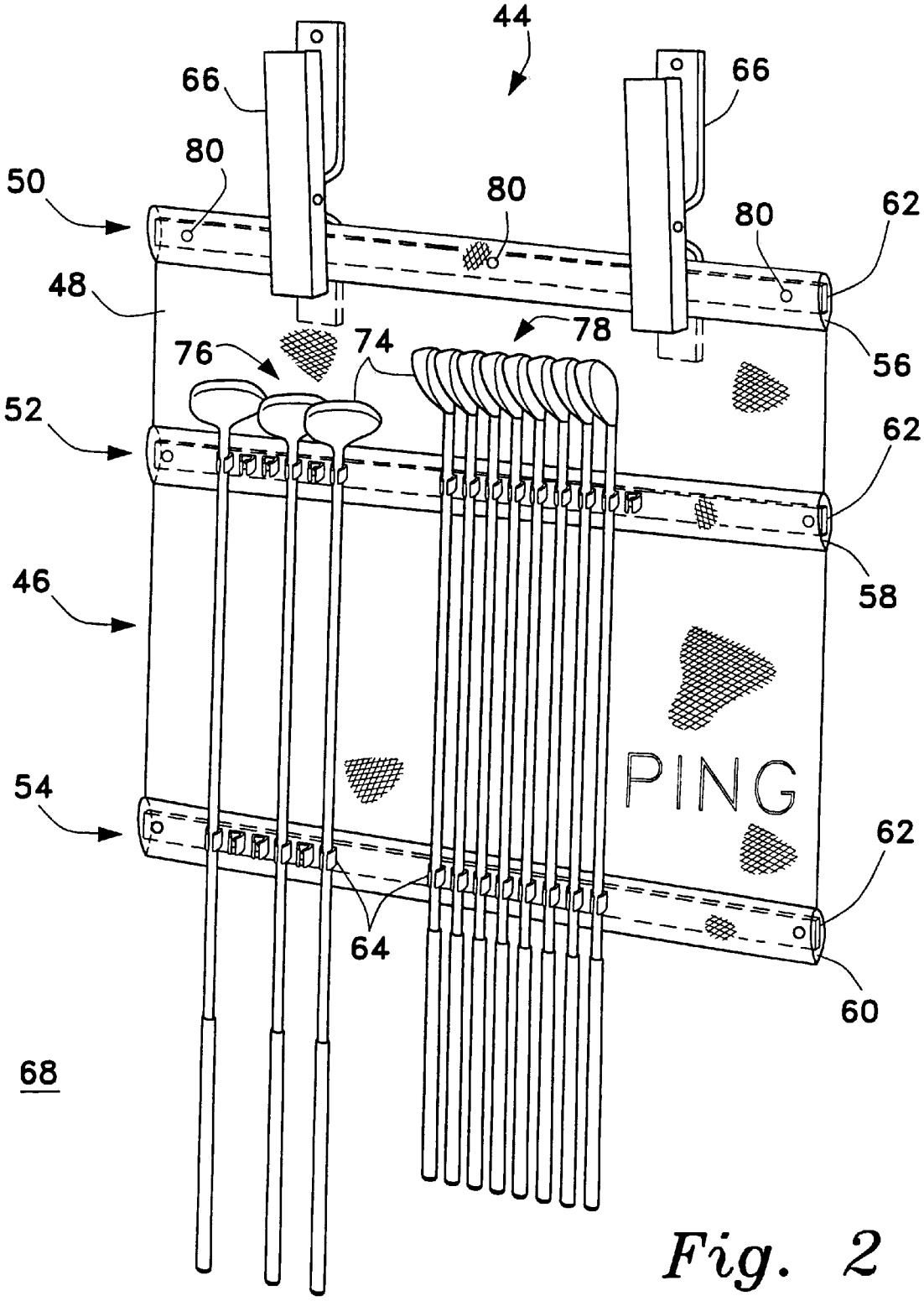
FIG. 2 is an environmental front perspective view of a golf club cleaning rack according to the present invention.
Figure 3:
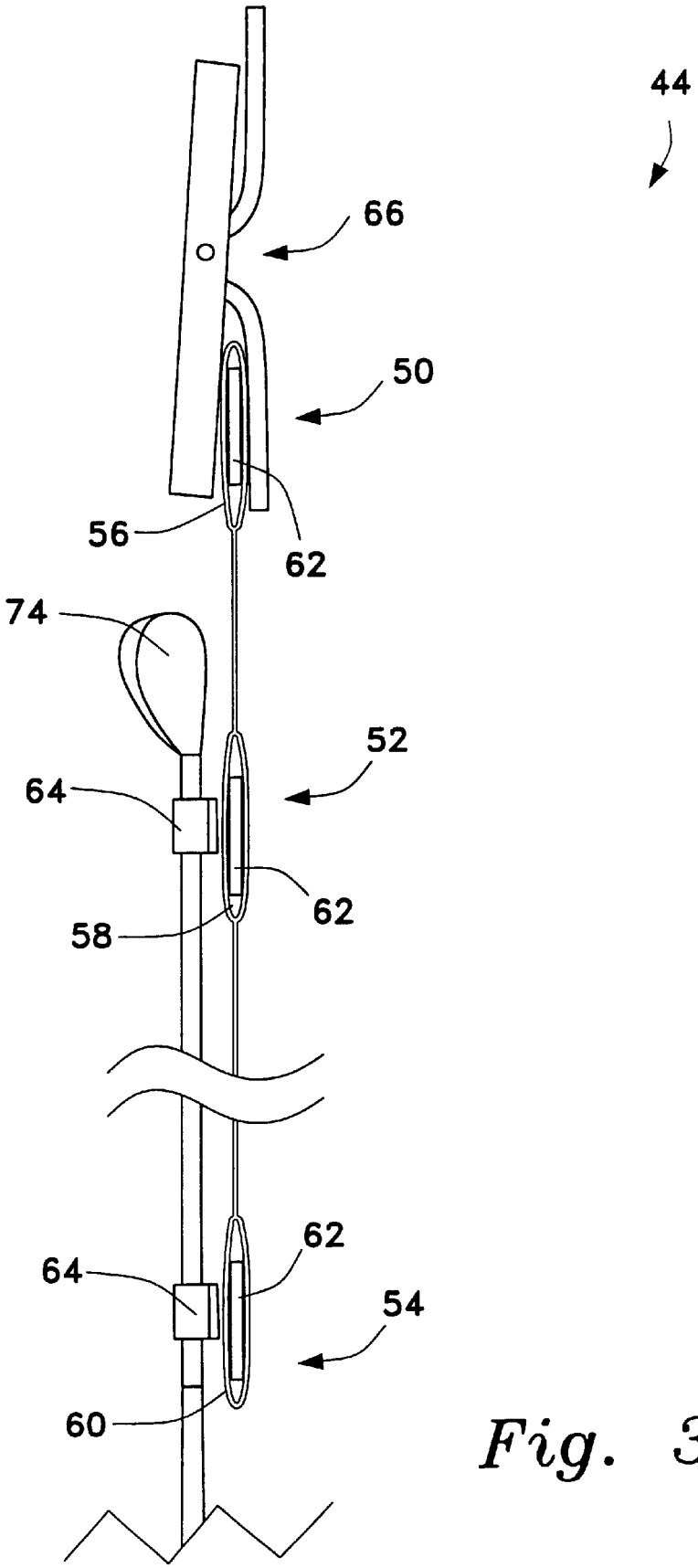
FIG. 3 is a side elevational view of the golf club hanging rack as shown in FIG. 2.

The preferred embodiment of the present invention is illustrated in FIGS. 2 and 3. Here, the invention is a multiple golf club cleaning aid rack 44 for cleaning vertically arranged clubs 46. The rack 44 is made up of a rectangular flexible base 48 made of a durable fabric having a top portion 50, an intermediate portion 52 proximate the top portion, and a bottom portion 54. The top, intermediate and bottom portions are configured with horizontal pockets 56, 58 and 60, respectively. Metal support strips 62 such as aluminum is inserted in each pocket 56, 58 and 60. Of course, the strips 62 could be made of other stiff material, e.g., plastic, hard rubber, etc., if desired.

Pockets 58 and 60 have brackets 64 fastened through the fabric and directly to the enclosed support strips 62. The brackets 64 project outwardly from the rack, and are spaced equidistantly in two groups for holding golf clubs 46. The brackets 64 are formed of metal, resilient rubber or plastic and the like, and are aligned to support clubs 46 vertically.

Grips, such as clamps 66 which are normally positioned on a wall 68 of a car wash establishment, are used for suspending the multiple golf club holding rack 10, so that the golf clubs 46 may be cleaned with a power wash normally found in such establishments. The uppermost strip 62 and its pocket 56 are dimensioned and configured such that the rack may be securely held and grasped by the clamps 66. As set forth above, the brackets 64 are conveniently divided into two sets for the wood drivers 76 and for the iron clubs 78. A set of apertures 80 are conveniently formed in the upper portion for support of the rack 10 by available hooks (not shown) on a home wall, for example, or other convenient location.

This cleaning rack has the advantage of being readily folded for portage or storage, and requires a minimum of metal or other material strengthening parts. Also, it is versatile in use, in that it can be deployed in a car wash establishment, or it could be used most any place, such as at home, suspended on an outside wall.

It is to be understood that the present invention is not limited to the embodiments described above, but encompasses any and all embodiments within the scope of the following claims.

I claim:

1. A multiple golf club cleaning aid rack for cleaning clubs arranged vertically comprising:

a rectangular flexible base made of a durable fabric, and having a top portion, an intermediate portion proximate the top portion, and a bottom portion, and wherein said top, intermediate and bottom portions are configured with horizontal pockets;

a support and stiffening strip inserted in each of said pockets;

each of said horizontal pockets of said intermediate and bottom portions including projecting brackets for holding golf clubs; and means on said rack for cooperating with suspending means, for holding the rack in position for cleaning golf clubs.

2. The multiple golf club cleaning aid rack according to claim 1, wherein the brackets are mounted onto and project from the support strips, the brackets being divided into sets for woods and irons.

3. The multiple golf club cleaning aid rack according to claim 1, wherein the support strips are made of metal.

4. The multiple golf club cleaning aid rack according to claim 3, wherein the metal strips are aluminum.

5. The multiple golf club cleaning aid rack according to claim 1, wherein said means on said rack for cooperating with suspending means comprise apertures formed in the upper portion, for support of the rack by hooks.

6. The multiple golf club cleaning aid rack according to claim 1, wherein said means on said rack for cooperating with suspending means comprise the uppermost one of said support strips and the pocket into which the uppermost strip is inserted, which are configured to be grasped by clamps affixed to a vertical wall surface.

7. The multiple golf club cleaning aid rack according to claim 1, wherein the club holding brackets are made of stiff rubber or plastic material.

8. A multiple golf club cleaning aid rack for cleaning clubs arranged vertically comprising:

a rectangular flexible base made of a durable fabric, and having a top portion, an intermediate portion proximate the top portion, and a bottom portion, and wherein said top, intermediate and bottom portions are configured with horizontal pockets;

a support and stiffening strip inserted in each of said pockets;

each of said horizontal pockets of said intermediate and bottom portions including projecting brackets for holding golf clubs, said brackets mounted onto and projecting from the support strips; and means on said rack for cooperating with suspending means, for holding the rack in position for cleaning golf clubs.

9. The multiple golf club cleaning aid rack according to claim 8, wherein the brackets are divided into sets for woods and irons.

10. The multiple golf club cleaning aid rack according to claim 8, wherein the support strips are made of metal.

11. The multiple golf club cleaning aid rack according to claim 10, wherein the metal strips are aluminum.

12. The multiple golf club cleaning aid rack according to claim 8, wherein said means on said rack for cooperating with suspending means comprise apertures formed in the upper portion, for support of the rack by hooks.

13. The multiple golf club cleaning aid rack according to claim 8, wherein said means on said rack for cooperating with suspending means comprise the uppermost one of said support strips and the pocket into which the uppermost strip is inserted, which are configured to be grasped by clamps affixed to a vertical wall surface.

14. The multiple golf club cleaning aid rack according to claim 8, wherein the club holding brackets are made of stiff rubber or plastic material.

* * * * *